United States Patent [19]

Kanegae et al.

[11] Patent Number: 4,491,112

[45] Date of Patent: Jan. 1, 1985

[54] FAILSAFE FOR AN ENGINE CONTROL

[75] Inventors: Hidetoshi Kanegae; Masaharu Asano; Seishi Yasuhara, all of Yokosuka; Masao Nakajima, Atsugi, all of Japan

[73] Assignee: Nissan Motor Company, Limited, Yokohama, Japan

[21] Appl. No.: 339,155

[22] Filed: Jan. 13, 1982

[51] Int. Cl.[3] ..... F02B 3/00; F02D 1/04; F02D 11/10

[52] U.S. Cl. ..... 123/479; 123/399; 123/357; 123/359; 123/397; 123/351

[58] Field of Search ..... 123/399, 479, 351, 359, 123/397

[56] References Cited

U.S. PATENT DOCUMENTS

| | | | |
|---|---|---|---|
| 4,098,242 | 7/1978 | Anderson | 123/359 |
| 4,312,315 | 1/1982 | Takase | 123/479 |
| 4,393,833 | 7/1983 | Mann | 123/397 |

*Primary Examiner*—Ronald B. Cox

*Attorney, Agent, or Firm*—Schwartz, Jeffery, Schwaab, Mack, Blumenthal & Koch

[57] ABSTRACT

A failsafe system for an engine-control servomotor compares a servomotor command signal to a feedback signal from the servomotor. When the magnitude of the difference between the two signals is greater than a predetermined value for a predetermined time, the failsafe system shuts down the servomotor or performs some other engine shut-down procedure. The failsafe system includes a comparator for comparing the two signals, the output of which leads to two other op-amp-type comparators connected in parallel, which work on negative or positive outputs of the first-mentioned comparator, respectively. Each of the later comparators receives a reference voltage input against which to compare the output of the first-mentioned comparator. Their outputs lead parallelly to time-delay circuits which check for a positive output for a predetermined length of time by a well-known capacitor-integration technique.

7 Claims, 5 Drawing Figures

FAILSAFE FOR AN ENGINE CONTROL

BACKGROUND OF THE INVENTION

The present invention relates to an internal combustion engine, and more particularly to a failsafe system for detecting malfunctions of a device which controls the amount of fuel or intake air supplied to an engine, and for taking safety measures when a malfunction occurs.

In devices which control the fuel injection rate employed in, or the flow rate of intake air supplied to, engines, such as diesel or spark spark ignition engines servo control systems have generally been used. Such systems use an actuator, such as a servomotor, for the controlled device, and a detector for sensing the position or state of the controlled device to feed back a signal indicative of the state of the device to be used to further refine the controlled state of the system.

In such a servo control system, the servomotor is required to adjust rapidly to correct its speed and direction during operation. Furthermore, the control system is normally mounted directly on the engine of an automotive vehicle and therefore the environment in which it is used is very severe with regard to vibrations and/or heat. Thus malfunctions due to motor seizure or interruption of electrical connection leads are liable to occur.

When such malfunctions occur in prior art control systems, the device actuated by the servomotor will suddenly be operating without proper control. It is possible in such a case for the engine speed to increase to damaging or even dangerous levels.

SUMMARY OF THE INVENTION

It is therefore an object of the present invention to provide a failsafe mode of operation and device for an engine control system, which detects malfunctions in the control system and stops the engine at that time, thereby eliminating the possibility of unrestrained engine operation.

According to the present invention, a malfunction is recognized when the state in which the difference between a command signal for a servo system and a feedback signal indicative of the instantaneous position or state of a controlled device is greater than a predetermined value and has lasted for more than a predetermined time duration. Also, when malfunction has been recognized, an engine stopping means, such as a fuel injection shut off valve, is operated to forcibly stop the engine.

DETAILED DESCRIPTION OF THE PREFERRED EMBODIMENT

Diesel Engine Control

Figure 1:
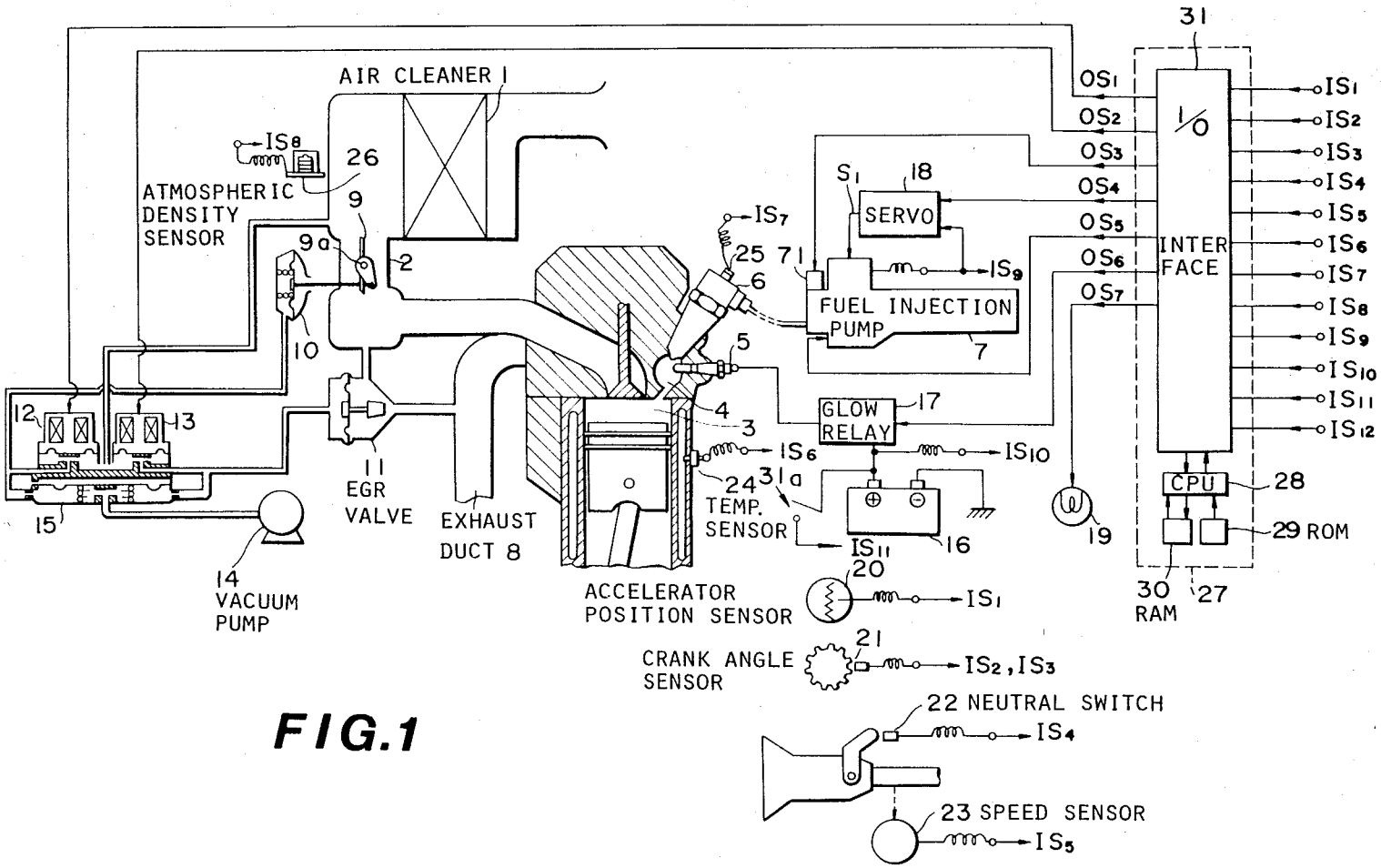
FIG. 1 shows an example of a control system for a diesel engine, to which the present invention is applied.

In FIG. 1 of the drawings, intake air is conducted via an air cleaner 1 in an air intake duct 2 to a main combustion chamber 3 of an engine. A swirl chamber 4 is provided with a glow plug 5 to preheat fuel injected from an injection nozzle 6 into the chamber 4. Where the engine is a diesel, a diaphragm valve 10 controls the opening of a throttle valve 9 controlling the amount of intake air to the engine. An EGR valve 11 controls the amount of EGR (exhaust gas recirculation) from an exhaust duct 8 to the air intake duct 2. A vacuum pump 14 or other vacuum pressure source is connected to a chamber 15 to maintain therein a reference vacuum pressure. Electromagnetic valves 12 and 13 control the connection of the reference pressure to the pressure-actuated diaphragm valve 10 and EGR valve 11, respectively, in order to adjust the actuation pressure derived from the air intake duct 2. A glow plug relay 17 controls the flow of electric current from a power supply 16 to the glow plug 5. A servo circuit 18 controls the output of fuel from a fuel injection pump 7 to the injection nozzle 6. An indicator lamp 19 indicates the state of supply of electric current to the glow plug 5. An accelerator position sensor 20 outputs a signal $IS_1$ indicative of the position (depression angle) of an accelerator, not shown. A crank angle sensor 21 produces a reference pulse $IS_2$ for each reference crank angle (for example 120°) rotation, and a unit pulse $IS_3$ for each unit crank angle (for example 1°) rotation. A neutral switch 22 outputs a signal $IS_4$ when it detects that the transmission is in the neutral position. A vehicle speed sensor 23 outputs a vehicle speed signal $IS_5$ indicative of the vehicle speed, the speed signal being determined by the rotational speed of the output shaft of the transmission. A temperature sensor 24 outputs a temperature signal $IS_6$ indicative of the temperature of cooling water for the engine. A lift sensor 25 outputs a signal $IS_7$ each time the injection nozzle 4 starts to inject fuel, the lift sensor being for example a switch or piezoelectric element actuated by fuel pressure. An atmospheric density sensor 26 outputs a signal $IS_8$ indicative of the atmospheric density determined by the temperature and pressure of the atmosphere. A sleeve position signal $IS_9$ indicates the position of a sleeve, to be later described in more detail, which controls the amount of fuel injected from the injection pump 7. $IS_{10}$ denotes a signal indicative of the battery voltage.

A calculating system 27 comprises, for example, a microcomputer which includes a central processing unit (CPU) 28, a read only memory (ROM) 29, a read/write memory (RAM) 30, and an input/output interface 31.

The calculating system 27 receives the abovementioned signals $IS_1$ to $IS_{10}$, a starter signal $IS_{11}$ and a glow signal $IS_{12}$. The starter signal $IS_{11}$ is outputted from the manually operated key or starter switch 31*a* which is closed for operating the starter motor. The glow signal $IS_{12}$ is outputted from a glow switch, not shown, provided in the instrument panel and used to preheat the cylinders, in the diesel engine embodiment before start-up. The calculating system 27 outputs various control signals $OS_1$–$OS_7$ for controlling the diesel engine optimally.

The throttle valve-opening control signal $OS_1$ and the EGR control signal $OS_2$ are pulse signals whose duty cycles control the duty cycles of electromagnetic valves 12, 13, thereby controlling the opening of the throttle valve 9 and the EGR valve 11, respectively, in well-known manners.

The fuel shut-off control signal $OS_3$ controls the operation of a fuel shut-off valve 71 (for stopping the engine) provided in the injection pump 7.

The fuel injection rate control signal $OS_4$ and the sleeve position feedback signal $IS_9$ are supplied to the servo block 18 which outputs a servo signal $S_1$ for controlling the position of the sleeve, and thus, the fuel injection rate. The servo block 18 responds to the feedback signal $IS_9$ to correct the servo signal $S_1$ to match control signal $OS_4$, so that the difference between the feedback signal $IS_9$ and the control signal $OS_4$ will normally stay within a limited range.

The injection timing control signal $OS_5$ controls an injection timing control mechanism provided in the injection pump 7 and therefore fuel injection timing. Injection timing is feedback controlled, using the injection start signal $IS_7$ from the lift sensor 25.

The glow plug control signal $OS_6$ controls the glow plug relay 17 and therefore the supply of electric current to the glow plug 5.

The indicator lamp control signal $OS_7$ controls the turning on and off of the glow plug indicator 19 to thereby indicate whether or not the glow plug 5 is being operated. For example, when the glow plug is being operated, the indicator lamp 19 is lighted while when the glow plug is de-energized, the indicator lamp 19 is turned off.

FUEL INJECTION PUMP

Figure 2:
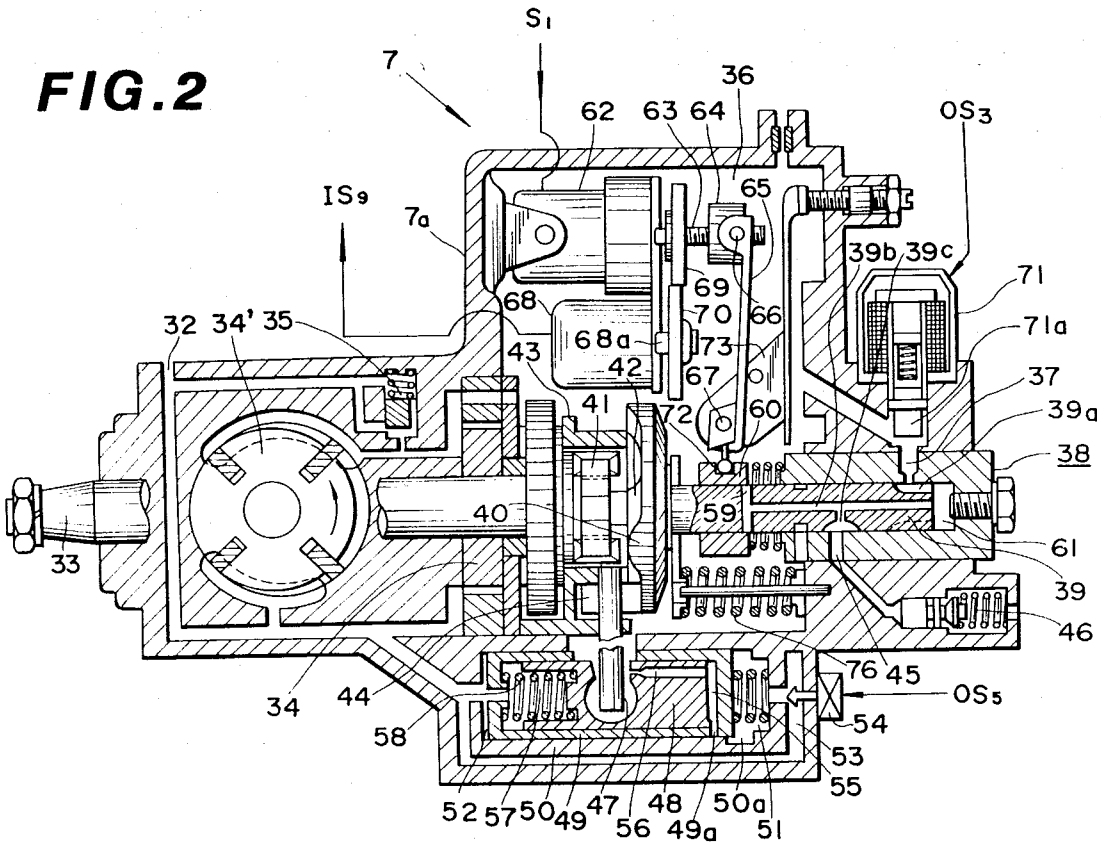
FIG. 2 is a cross-sectional view of the injection pump used in the system of FIG. 1.

In the injection pump 7 shown in FIG. 2, fuel is drawn into the inlet 32 of the body of a feed pump 34 which is driven by the drive shaft 33 connected to the output shaft, not shown, of the engine. To facilitate understanding of the pump 34, it is shown at 34' as being rotated through 90 degrees. The pressure of the fuel discharged from the pump 34 is controlled by a pressure regulator valve 35 and is then supplied to a pump chamber 36 formed within the pump housing. The fuel enters a high-pressure plunger pump 38 through an inlet port 37. The fuel within the pump chamber 36 lubricates the operating parts of the pump arrangement.

The plunger 39 of the pump 38 is connected to an eccentric disc 40, which is loosely connected through keys 41 to the drive shaft 33 to be driven at a rotational rate proportional to the engine rotation. The eccentric disc 40 has the same number of cam faces 42 as the engine has cylinders, and translates axially, while being rotated, as the individual cam faces 42 pass over rollers 44 disposed along a roller ring 43 which is supported rotatably around the axis of the drive shaft 33, the rollers 44 each being supported pivotably by a respective one of radial shafts, not shown, secured angularly spaced to the roller ring 43, as shown in U.S. Pat. No. 4,177,775. The disc 40 and therefore the plunger are biassed via a push plate 75 by a coil spring 76 against the rollers 44. Thus, when the drive shaft 33 is driven, the plunger 39 rotates while reciprocating. This reciprocal and rotating movement causes the fuel to be drawn into a chamber 61 through an intake port 37 and one of grooves **39*a* provided spaced circumferentially on the plunger 39 aligning with the inlet port 37 and to be forced under pressure through an axial groove 39*b* in the plunger from one of distributing ports 45 provided spaced circumferentially on the plunger 39 aligning with an outlet 39*c* in the plunger through the corresponding delivery valve 46 to the corresponding injection nozzle 6 of FIG. 1. Thus, the plunger 39 regulates the timing and rate of admission of fuel to the respective delivery valves 61 and therefore to the corresponding respective injection nozzles 6**.

The timing of fuel injection is regulated by changing the relative position of the cam faces 42 and rollers 44 via rotation of the roller ring 43. This roller ring is connected to a plunger 48 through a drive pin 47. In FIG. 2, for the convenience of description, the plunger assembly is shown rotated through 90 degrees. A cylinder 49 in which the plunger 48 is accommodated is slidably received within a casing 50 and has a pair of hydraulic chambers 51 and 52 on the right-hand and left-hand ends of the cylinder 49. Passageway **49*a* and 50*a* are provided to bring the hydraulic chamber 51 and a high pressure end chamber 55 into communication when the cylinder 49 has moved to the right in the figure. The hydraulic chamber 51 communicates with the other hydraulic chamber 52 and the inlet side of the feed pump 34 through a fuel passageway 53. An electromagnetic valve 54 is provided in a passageway through which the hydraulic chamber 51 can communicate with the fuel passageway 53. The fuel pressure within the pump chamber 36 is conducted through a passageway 56 into the high-pressure end chamber 55 on the right-hand side of the plunger 48 slidable within the cylinder 49. In contrast, a low-pressure end chamber 57 on the opposite side of the plunger 48 communicates with the drawing-in side 32 of the feed pump 34 and is normally at a relatively low pressure. However, the plunger 48 is urged to the right by the force of a spring 58. The fuel pressure within the pump chamber 36 increases in proportion to the rotational speed of the feed pump 34 so that when the passageway 49*a* is closed, as shown, the plunger 48 is pushed to the left in the figure as the engine speed increases. This rotates the roller ring 43 in the direction opposite the direction in which the eccentric disc 40** rotates so that the injection timing advances in accordance with the engine speed.

When the cylinder 49 moves to the right extreme in the figure due to the torque of the eccentric disc 40, and at the same time the electromagnetic valve 54 is open, the hydraulic chamber 51 and the high-pressure end chamber 55 communicate via the passageways **49*a* and 50*a* so that in this case the opening and closing of the electromagnetic valve 54 controls the pressure within the end chamber 55. Thus, the duty cycle of the valve 54, controlled by the injection timing control signal $OS_5$, controls the positioning of the roller ring 43** and thus the injection timing.

A fuel injection rate is determined by the position of a sleeve 60, slidable along the plunger 39, which is capable of covering a spill port 59 provided in the plunger 39. For example, if the opening of the spill port 59 goes beyond the right-hand end of the sleeve 60 due to the movement of the plunger 39 to the right in the figure, the fuel, which has been forced under pressure from the plunger pump chamber 61 through the axial passageway **39*b* and outlet 39*c* to the distributing port 45 aligning with the outlet 39*c*, will be vented into the pump chamber 36 through the spill port 59**, thereby circumventing the supply of fuel under pressure.

Specifically, if the sleeve 60 is displaced to the right relative to the plunger 39, the timing of cessation of fuel injection will be retarded so that the fuel injection rate will increase, whereas if the sleeve 60 is displaced to the left relative to the plunger 39, the timing of cessation of fuel injection will be advanced so that the fuel injection rate will decrease.

Of course, the movement of the ignition switch to the position where the starter motor is operated causes the sleeve 60 to move to the start-up injection position. The subsequent positions of the sleeve and therefore the servomotor are controlled by the values read out from a memory table in the ROM 29 in FIG. 1 according to the instantaneous engine speeds and loads.

The control of the sleeve 60 position is carried out by a servomotor 62, supported on the pump housing *7a*, which has an outside threaded shaft 63 which is screwed into an inside threaded hole provided at the center of a slider 64, which thereby moves axially in response to rotation of the shaft 63.

Connected pivotally at a pin 66 to the slider 64 is a link lever 65 which is also supported at a pivot 67 of a support 73 and engaged with the sleeve 60 via a pivot pin 72 provided at the end of the link lever 65.

Thus, when the servomotor 62 rotates in one direction or other, the slider 64 moves to the right or left in the figure so that the link lever 65 turns around the pivot 67 in one direction or the other, thereby moving the sleeve 60 to the left or right. The control of the servomotor 62 is effected by the servo signal $S_1$ outputted from the servo circuit 18 according to the fuel injection rate control signal $OS_4$.

Thus, there is no direct correspondence relationship between the depression of the accelerator pedal and the fuel injection rate. That is, the accelerator pedal only acts to transmit the driver's desire to "acceleration" or "deceleration" to the calculating device 27 which calculates an optimal fuel injection rate according to the operating state of the engine at that time and effects a corresponding optimal control according to the fuel injection rate control signal $OS_4$.

A potentiometer 68 is provided in the vicinity of the servomotor 62 and has a shaft 68*a* which is connected to the shaft 63 of the servomotor 62 through gears 69 and 70 secured to the shafts 63 and 68*a*, respectively, so that when the servomotor 62 is operated, the gears 69 and 70 are rotated, whereby the potentiometer 68 produces a sleeve position signal $IS_9$ which indicates the position of the sleeve 60.

An electromagnetic fuel shut-off valve 71 is controlled by the fuel shut off control signal $OS_3$ mentioned hereinbefore with respect to its opening and closing. When the signal $OS_3$ indicates a shut-off command, the intake port 37 is closed by a valve member 71*a* to shut off the supply of fuel, thereby stopping the engine.

MALFUNCTION DETECTOR

Figure 3:
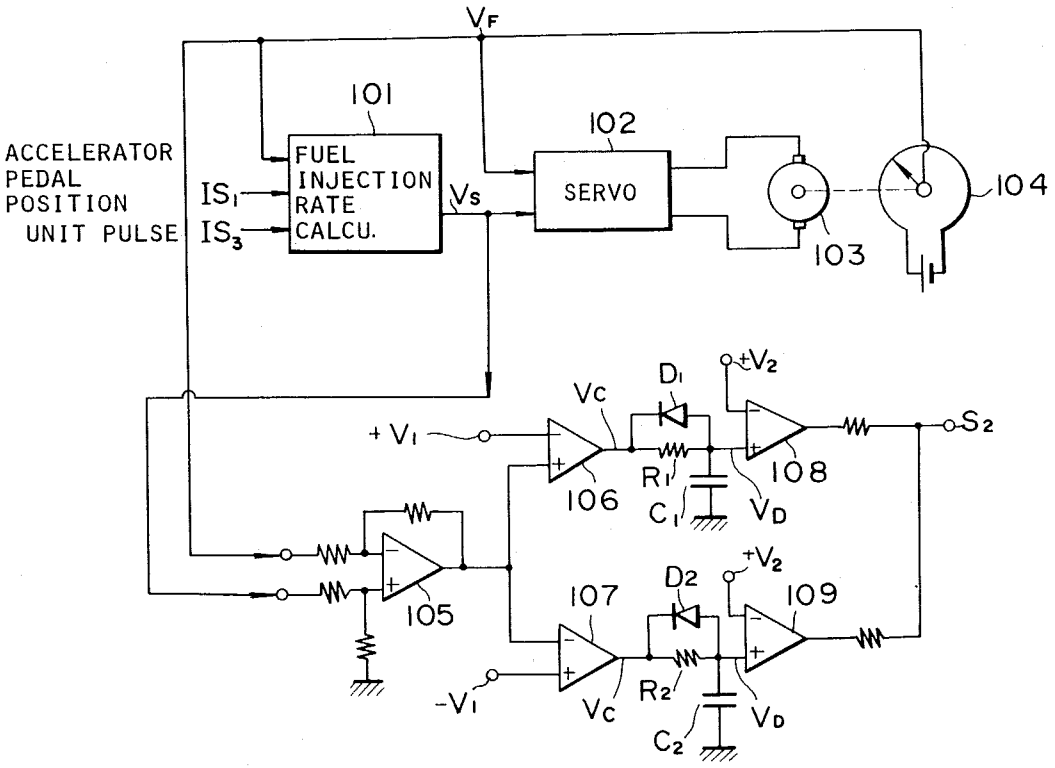
FIG. 3 shows an embodiment of a failsafe system according to the present invention.

In FIG. 3, a calculating block 101 (corresponding to 27 of FIG. 1) calculates the fuel injection rate in accordance with the current values of the accelerator pedal position signal $IS_1$, the unit pulse signal $IS_3$, a feedback signal $V_F$ (to be described later in more detail), the engine cooling-water temperature signal, the atmospheric density signal, and so forth and outputs a command signal $V_S$ (corresponding to $OS_4$ of FIG. 1).

A servo block 102 (corresponding to the block 18 of FIG. 1) controls the servomotor 103 (corresponding to the servomotor 62 of FIG. 2) so as to nullify the discrepancy between the command signal $V_S$ and the feedback signal $V_F$.

A potentiometer 104 (corresponding to 68 of FIG. 2) outputs a feedback signal $V_F$ (corresponding to the signal $IS_9$ of FIG. 1) indicative of the rotational position of the servomotor and therefore the position of the sleeve 60 which controls the fuel injection rate.

A differential amplifier 105 amplifies and outputs the difference between the command signal $V_S$ and the feedback signal $V_F$.

Comparators 106 and 107 output high level signals $V_C$ when the magnitude of the difference between $V_S$ and $V_F$ is larger than a predetermined value $V_1$; in the case of $V_F<V_S$, the comparator 106 outputs a high-level $V_C$ when the difference is larger than the predetermined value $V_1$ whereas in the case of $V_F>V_S$, comparator 107 outputs a high-level $V_C$ when the difference is larger than the predetermined value $V_1$.

A diode $D_1$, a resistor $R_1$, and a capacitor $C_1$ constitute a time-delay circuit, including an integrator, between the output of comparator 106 and the input of a comparator 108, and a diode $D_2$, a resistor $R_2$ and a capacitor $C_2$ constitute a similar circuit between the output of comparator 107 and the input of comparator 109. Thus, when the signals $V_C$ goes high, the time constant defined by the resistor $R_1$ and capacitor $C_1$, or the resistor $R_2$ and capacitor $C_2$ determine the rate of charging of the capacitors $C_1$ and $C_2$, respectively, while when the signals $V_C$ goes low, the charge at the capacitors $C_1$ and $C_2$ rapidly discharge through the diodes $D_1$ and $D_2$.

The comparators 108 and 109 output a high level signals to the terminal $S_2$ when the output voltages $V_D$ across the capacitors $C_1$ and $C_2$ respectively are higher than a predetermined value $V_2$.

Figure 4:
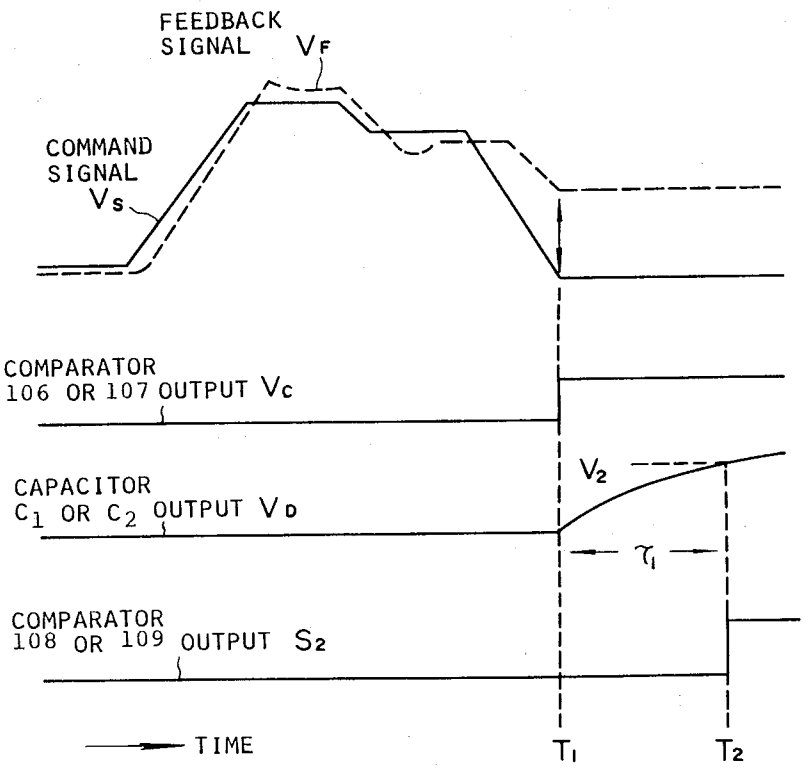
FIG. 4 is a waveform diagram for the circuit of FIG. 3.

As shown in FIG. 4, even in the normal state, there will be slight, varying discrepancies between the command signal $V_S$ and the feedback signal $V_F$. The state $|V_S-V_F|>V_1$ can transiently occur, but it is normally corrected within an interval $\tau_1$. When, however, events such as seizure and/or malfunction of the servomotor occur, the state $|V_S-V_F|>V_1$ is sustained so that $V_C$ remains high starting from the time $T_1$ when the $|V_S-V_F|>V_1$ state first occurred. If this state continues for more than the predetermined interval $\tau_1$, the signal $S_2$ goes high at the time $T_2=T_1+\tau_1$ when $V_D$ becomes greater than $V_2$. In response to a high-level signal $S_2$ (corresponding to fuel shut-off control signal $OS_3$), the fuel shut-off valve 71 closes to shut off the supply of fuel, thereby stopping the engine. The high-level signal $S_2$ may be used to additionally operate an alarm lamp to indicate the occurrence of such an event.

In the case of a diesel engine, when the signal $S_2$ goes high, the fuel shut-off valve 71 can be turned off, or the throttle valve 9 can be closed completely, thereby stopping the engine. In the case of a spark ignition engine, on the other hand, the power supply for the spark ignition can be turned off or the fuel supply can be stopped. In order to stop the fuel supply in a gasoline engine, the electrical fuel pump should be stopped, or in an electronically-controlled fuel injection system, the supply of the injection pulses should be stopped. A combination of the means mentioned above may be used.

The malfunction-detecting mechanism shown in FIG. 3 may consist of a microcomputer (27 in FIG. 1).

Figure 5:
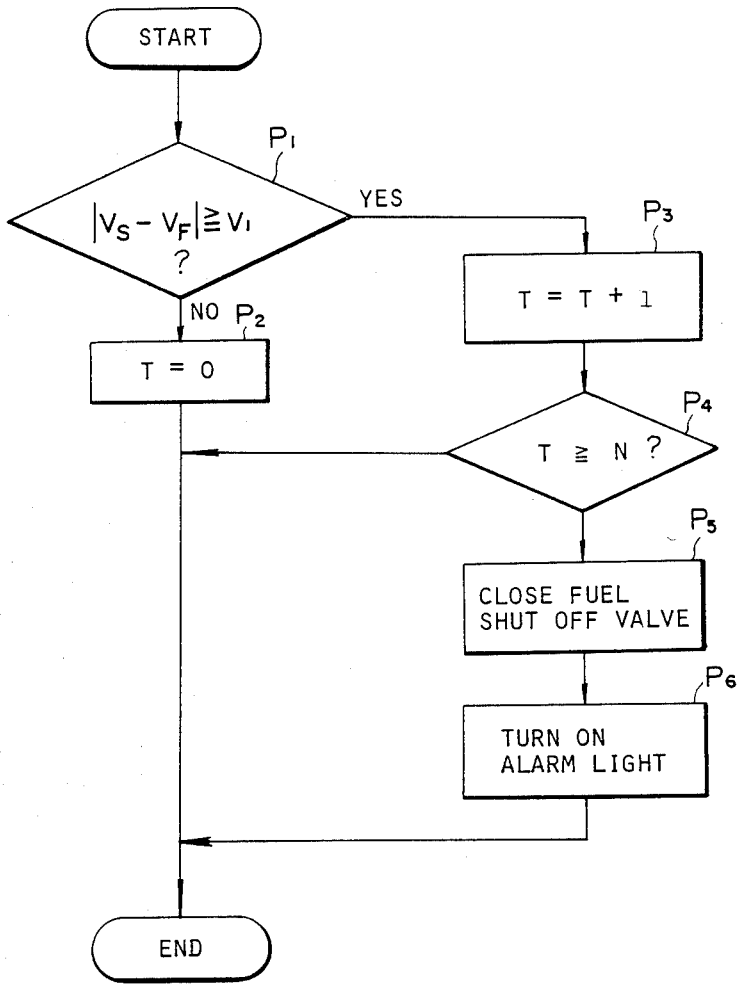
FIG. 5 shows a flowchart for carrying out the present invention.

FIG. 5 shows a flowchart for detecting such malfunctions using a microcomputer. The calculation of FIG. 5 should be repeatedly executed at a predetermined frequency or synchronously with the rotation of the engine.

In the first execution step $P_1$, the determination is made as to whether the difference between the command signal $V_S$ and the feedback signal $V_F$ is larger than a predetermined value $V_1$. If the determination is NO, which means that there are no malfunctions or accidents occurring, a counter is reset to $T=0$ at a step $P_2$ and then the program goes to END immediately. If the determination is YES at $P_1$, the counter is incremented by one at a step $P_3$ and then the determination is made as to whether the count in the counter is larger than a predetermined value N corresponding to a time $\tau_1$ at a step $P_4$.

If the determination is NO at $P_4$, which implies that there may still be no serious malfunction, the program goes to END immediately. If the determination is YES at $P_4$, indicative of a state in which the difference between $V_S$ and $V_F$ is larger than the predetermined value $V_1$ for more than the predetermined time $\tau_1$ and thus indicative of the occurrence of a malfunction, the fuel shut-off valve is closed at a step $P_5$, thereby stopping the engine, and the alarm lamp is operated at a step $P_6$ to indicate the cause of the engine shut-down.

As described above, according to the present invention, the determination is made that a fuel injection pump is malfunctioning when the state in which the difference between the fuel injection rate command signal and a feedback signal is larger than a predetermined value continues for more than a predetermined time. Thus, malfunction of the whole servo-control system which includes the servomotor, the potentiometer and the servo circuits can be detected. Further, in the event of a malfunction, an engine-stopping means such as a fuel shut-off valve can be operated to stop the engine so that there is no possibility that the engine will be damaged by running at an excessively high, or otherwise uncontrollable, rate.

The present invention also applies to the device in which the throttle valve 9 is controlled by a servo system such as shown in FIG. 3, as well as to the device in which the throttle valve of a spark ignition engine is controlled by a servo system. In these cases, the block diagram of FIG. 3 should be modified such that the block 101 is replaced by an intake air flow rate calculating block having as inputs the accelerator pedal position signal $IS_1$ and the unit pulse signal $IS_3$. The signal $V_S$ in FIG. 3 should represent an intake air flow rate command signal. The shaft of the servomotor 103 should be coaxially secured to the shaft 9a of the throttle valve 9 of FIG. 1. Thus, the diaphragm valve 10 and the electromagnetic valve 12 should be removed.

While the present invention has been described and shown in terms of a preferred embodiment thereof, it should be noted that the present invention should not be limited to the embodiment. Various changes and modifications could be made by those skilled in the art without departing from the spirit and scope of the present invention as set forth in the attached claims.

What is claimed is:

1. A failsafe system for producing a command signal for controlling a controlled device of an engine comprising:

(a) means for generating a feedback signal indicative of the state of said controlled device;

(b) a controller for controlling the state of said controlled device whereby an absolute difference in magnitude between said feedback signal and said command signal is within a predetermined range;

(c) a malfunction determining means comprising a first circuit including a first comparator for comparing a difference between said command signal and said feedback signal with a first predetermined level and for generating a first output when said command signal is greater than said feedback signal and said difference exceeds the first predetermined level, a first integrator for integrating the first output from said first comparator, and a second comparator for comparing the output of said integrator with a second predetermined level to generate a malfunction signal when the output of said first integrator exceeds the second predetermined level; and wherein said malfunction determining means further comprises a second circuit including a third comparator for comparing a difference between said command signal and said feedback signal with the first predetermined level and for generating a second output when said command signal is smaller than said feedback signal and said difference exceeds the first predetermined level, a second integrator for integrating the second output, and a fourth comparator for comparing the output of said second integrator with the second predetermined level to generate a malfunction signal when the output of said second integrator exceeds the second predetermined level.

2. A failsafe system as claimed in claim 1, wherein said first and second integrators include means responsive to the absence of the second output to reset the integrated value of said integrators to zero.

3. A failsafe system as set forth in claim 1, further including means for stopping said engine in response to said malfunction signal.

4. A failsafe system as claimed in claim 3, wherein said engine is a diesel engine having a fuel supply and said stopping means comprises a valve for shutting off the fuel supply to said diesel engine.

5. A failsafe system as claimed in claim 3, wherein said engine is a spark ignition engine having a spark ignition system and said stopping means comprises means for cutting off power supply to said spark ignition system.

6. A failsafe system as claimed in claim 3, wherein said engine has an electrically-controlled fuel injection system and said stopping means comprises means for interrupting injection pulses from said electronically-controlled fuel injection system.

7. A failsafe system as claimed in claim 3, wherein said engine has a throttle valve and said stopping means is operable to completely close said throttle valve.

* * * * *